US009506332B2

(12) United States Patent
Saeedfar

(10) Patent No.: US 9,506,332 B2
(45) Date of Patent: Nov. 29, 2016

(54) METHOD FOR ENHANCED HYDROCARBON RECOVERY USING IN-SITU RADIO FREQUENCY HEATING OF AN UNDERGROUND FORMATION WITH BROADBAND ANTENNA

(71) Applicant: Husky Oil Operations Limited, Calgary (CA)

(72) Inventor: Amin Saeedfar, Calgary (CA)

(73) Assignee: Husky Oil Operations Limited, Calgary (CA)

( * ) Notice: Subject to any disclaimer, the term of this patent is extended or adjusted under 35 U.S.C. 154(b) by 0 days.

(21) Appl. No.: 14/587,473

(22) Filed: Dec. 31, 2014

(65) Prior Publication Data

US 2015/0192004 A1 Jul. 9, 2015

Related U.S. Application Data

(60) Provisional application No. 61/924,919, filed on Jan. 8, 2014.

(51) Int. Cl.

| | |
|---|---|
| ***E21B 43/24*** | (2006.01) |
| ***E21B 47/12*** | (2012.01) |
| ***E21B 36/00*** | (2006.01) |
| ***E21B 43/26*** | (2006.01) |
| *H01Q 1/04* | (2006.01) |

(52) U.S. Cl.

CPC ..... *E21B 43/2401* (2013.01); *E21B 36/00* (2013.01); *E21B 43/24* (2013.01); *E21B 43/26* (2013.01); *E21B 47/122* (2013.01); *H01Q 1/04* (2013.01)

(58) Field of Classification Search

None

See application file for complete search history.

(56) References Cited

U.S. PATENT DOCUMENTS

| | | | | |
|---|---|---|---|---|
| 3,114,875 | A * | 12/1963 | Haagensen | 324/338 |
| 5,132,623 | A * | 7/1992 | De et al. | 324/338 |
| 6,094,176 | A * | 7/2000 | Van Hoozen | H01Q 11/105 343/792.5 |
| 2005/0199386 | A1* | 9/2005 | Kinzer | 166/248 |
| 2006/0170424 | A1* | 8/2006 | Kasevich | 324/338 |
| 2007/0108202 | A1* | 5/2007 | Kinzer | 219/772 |
| 2009/0189617 | A1* | 7/2009 | Burns et al. | 324/649 |
| 2009/0242196 | A1* | 10/2009 | Pao | 166/248 |
| 2011/0108277 | A1* | 5/2011 | Dudley et al. | 166/308.1 |
| 2011/0234421 | A1* | 9/2011 | Smith | 340/854.3 |

* cited by examiner

*Primary Examiner* — Angela M DiTrani
*Assistant Examiner* — Anuradha Ahuja
(74) *Attorney, Agent, or Firm* — Frost Brown Todd LLC

(57) ABSTRACT

A method for enhanced subsurface hydrocarbon recovery, comprising the use of at least one in-situ broadband antenna to radiate radio frequency energy into the reservoir to heat a target zone. The use of a broadband antenna allows for compensation of growing impedance mismatch between the antenna and the reservoir that occurs during recovery operations.

29 Claims, 3 Drawing Sheets

METHOD FOR ENHANCED HYDROCARBON RECOVERY USING IN-SITU RADIO FREQUENCY HEATING OF AN UNDERGROUND FORMATION WITH BROADBAND ANTENNA

FIELD OF THE INVENTION

The present invention relates to enhanced hydrocarbon recovery methods, and more particularly to the use of electromagnetic (EM) energy in the recovery of subsurface hydrocarbons.

BACKGROUND OF THE INVENTION

Heavy oil is a term commonly applied to describe oils having a specific gravity less than about 20° API. These oils, which include oil sand bitumen, are not readily producible by conventional techniques. Their viscosity is so high that the oil cannot easily be mobilized and driven to a production well by a pressure drive. Therefore, a recovery process is required to reduce the viscosity and then produce the oil.

Thermal recovery methods as applied in heavy oil have the common objective of accelerating the recovery process. Raising the temperature of the host formation reduces the heavy oil viscosity, allowing the near solid material at original temperature to flow as a liquid. It is known in the art of hydrocarbon recovery, and particularly in the recovery of heavy and unconventional hydrocarbons from subsurface reservoirs, to employ the use of steam or steam-solvent mixtures as injectants to reduce the viscosity of the hydrocarbons and allow them to flow to a producing well and thereby be produced to surface. For example, cyclic steam stimulation (CSS) and steam-assisted gravity drainage (SAGD) methods employ steam to mobilize subsurface heavy hydrocarbon such as heavy oil or bitumen. However, the effectiveness of steam injection methods is limited in most cases to about a 2500 ft. depth. At such depth, heat losses in surface steam lines and in the wellbore reduce the steam quality to a value generally insufficient to provide the high heat ratio at the reservoir required for an economical oil flow rate. These oils are often produced as emulsions with water by using common recovery techniques.

There are certain other situations where steam injection may not work well. These situations can include the following:

- Thin pay-zones, where heat losses to adjacent (non-oil-bearing) formations may be significant.
- Low permeability formations, where the injected fluid may have difficulty penetrating deep into the reservoir.
- Reservoir heterogeneity, where high permeability streaks or fractures may cause early injected fluid breakthrough and reduce the sweep.

It has long been recognized that such recovery methods can be costly to implement and operate and requires access to significant water resources. Alternative methods have accordingly been developed that employ electromagnetic heating techniques, in which antennae are positioned downhole adjacent a target reservoir and generate electromagnetic energy to heat and thereby mobilize the heavy hydrocarbons, enabling production to surface.

Electromagnetic (EM) heating has been considered as a viable alternative to steam-based thermal processes since electrical instruments are widely available and its use requires a minimal surface presence, so it is particularly favorable in populated areas or in offshore sites. EM heating is a thermal process, which may be applied to a well to increase its productivity by the removal of thermal adaptable skin effects and the reduction of oil viscosity near the well bore. Electric current leaves the power supply and is conducted down by the power delivery system (transmission line) to the antenna assembly for the radio frequency (RF) case. The antenna is an electrical device that can radiate the EM energy into the reservoir formation.

EM-thermal processes are generally understood to be free of issues related to very low initial formation injectivity, poor heat transfer, shale layers between rich oil layers, cap rock requirement, and the difficulty of controlling the movement of injected fluids and gases, all of which have impacted other thermal recovery processes such as SAGD. Apart from these, EM-thermal recovery is also commonly understood to present the following advantages when compared with other recovery technologies:

- Heat is generated in-situ.
- It does not need a working fluid.
- It does not need a significant water supply.
- It can reduce the produced water cut.
- It is independent of formation permeability.
- There is no apparent depth limit.
- There is no emission concern.
- There are no hazardous chemical concerns.
- It increases apparent permeability.
- It appears to be cost competitive to steam flood for shallow reservoirs and less expensive for deep reservoirs.
- It heats uniformly and near-instantaneously from within and therefore is independent of the low thermal conductivity of the formation.
- It increases the pressure and energy of the formation prior to production While it is commonly held that electromagnetic heating techniques may show promise in certain applications, it is believed that improvements and enhancements may be possible and render such methods even more desirable. In particular, issues arise with the use of antennas, and optimization may be possible.

SUMMARY OF THE INVENTION

The present invention therefore seeks to provide a method for enhanced hydrocarbon recovery incorporating the use of one or more broadband antennas.

According to a first broad aspect of the present invention, there is provided a method for recovering hydrocarbon from a subsurface formation, the method comprising the steps of:

a. drilling at least one well into the formation adjacent the hydrocarbon;

b. positioning at least one antenna in the at least one well, the at least one antenna operable over a wide frequency bandwidth;

c. emitting electromagnetic energy from the at least one antenna into the formation;

d. allowing the electromagnetic energy to heat the hydrocarbon and reduce the viscosity of the hydrocarbon; and e. producing the heated hydrocarbon to surface.

In some exemplary embodiments, the at least one antenna can be at least one broadband antenna, at least one wideband antenna, or at least one frequency independent antenna. The electromagnetic energy is preferably in the radio frequency range, and most preferably in a lower part of the radio frequency range.

The at least one antenna may comprise a plurality of antennae in an array, and the array may be configured to direct the electromagnetic energy in a direction determined by at least one beamforming algorithm.

Some exemplary methods comprise the further steps after step e of: switching the at least one antenna from a high-power heating mode to a low-power transceiver mode; receiving data regarding formation characteristics using the at least one antenna; and transmitting the data using the at least one antenna. Such exemplary methods may further comprise the step of using the data to tune the at least one antenna and direct the electromagnetic energy.

According to a second broad aspect of the present invention, there is provided a method for improving an electromagnetic-thermal hydrocarbon recovery process employing at least one well in a formation adjacent a hydrocarbon, the method comprising the steps of:

a. positioning at least one antenna in the at least one well, the at least one antenna operable over a wide frequency bandwidth;

b. emitting electromagnetic energy from the at least one antenna into the formation;

c. allowing the electromagnetic energy to heat the hydrocarbon and reduce the viscosity of the hydrocarbon;

d. producing the heated hydrocarbon to surface; and e. allowing the antenna to compensate for impedance mismatch with variable electrical impedance of the formation during production.

According to a third broad aspect of the present invention, there is provided a method for improving an electromagnetic-thermal hydrocarbon recovery process employing at least one well in a formation adjacent a hydrocarbon, the method comprising the steps of:

a. calculating a post-desiccation impedance change in the formation near the at least one well;

b. applying at least one coat of dielectric material to at least one antenna to match the calculated post-desiccation impedance change;

c. positioning the at least one antenna in the at least one well;

d. emitting electromagnetic energy from the at least one antenna into the formation;

e. allowing the electromagnetic energy to heat the hydrocarbon and reduce the viscosity of the hydrocarbon; and f. producing the heated hydrocarbon to surface.

The method may comprise the application of a single layer of dielectric material to the at least one antenna, or a plurality of layers.

According to a fourth broad aspect of the present invention, there is provided a method for recovering hydrocarbon from a subsurface formation, the method comprising the steps of:

a. drilling at least one well into the formation adjacent the hydrocarbon;

b. calculating a post-desiccation impedance change in the formation near the at least one well;

c. applying at least one coat of dielectric material to at least one antenna to match the calculated post-desiccation impedance change;

d. positioning the at least one antenna in the at least one well;

e. emitting electromagnetic energy from the at least one antenna into the formation;

f. allowing the electromagnetic energy to heat the hydrocarbon and reduce the viscosity of the hydrocarbon; and g. producing the heated hydrocarbon to surface.

According to a fifth broad aspect of the present invention, there is provided a system for recovering hydrocarbon from a subsurface formation, the system comprising:

at least one production well drilled into the formation adjacent the hydrocarbon;

at least one electromagnetic energy application well drilled into the formation; and at least one antenna in the at least one electromagnetic energy application well, the at least one antenna operable over a wide frequency bandwidth;

wherein the at least one antenna is operable to emit electromagnetic energy into the formation to heat the hydrocarbon and reduce the viscosity of the hydrocarbon; and wherein the heated hydrocarbon is produced to surface through the at least one production well.

A detailed description of exemplary embodiments of the present invention is given in the following. It is to be understood, however, that the invention is not to be construed as being limited to these embodiments.

BRIEF DESCRIPTION OF THE DRAWINGS

In the accompanying drawings, which illustrate exemplary embodiments of the present invention.

Figure 1:
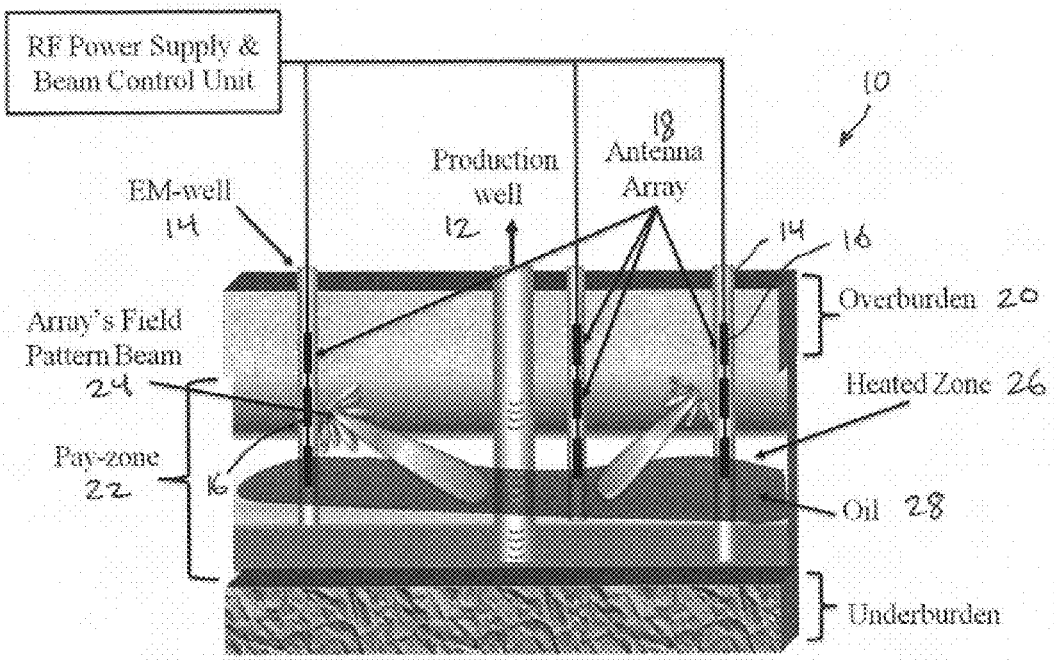
FIG. 1 is a simplified illustration of an antenna array in accordance with an embodiment of the present invention.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise forms of any exemplary embodiment. Accordingly, the description and drawings are to be regarded in an illustrative, rather than a restrictive, sense.

The exemplary embodiments are directed to the radio frequency (RF) range of EM heating, although other ranges of EM energy may be applicable. In the radio frequency range, the electrical resistivity and permittivity of a formation are first measured to select the proper frequency of the EM source and design the antennas' spacing in reservoir. One exemplary aspect of the present invention measures and images the characterization of a reservoir during the RF-thermal recovery process to better tune the antenna energy beam and frequency for efficient heating process, as will be described below.

The fundamental mechanism of electromagnetic heating involves electric conduction and/or dielectric polarization. Electric conduction (quantified by conductivity $\sigma$–S/m) is the basis for Joule heating, also known as ohmic heating and resistive heating, by which the passage of an electric current through a conducting medium releases heat. In a polarization mechanism, polar molecules or ions oscillate under the effect of an oscillating electromagnetic field, which produces heat.

An important factor that needs to be taken into account during an electromagnetic thermal process is the skin effect.

Exponential decreasing of EM wave penetration into materials is known as skin effect. The choice of the electromagnetic source frequency in an EM thermal process is a compromise between fast heating (greater heat rate) and depth of penetration, usually for non-dispersive materials, the lower the frequency the deeper the EM waves penetrate in the reservoir.

The low frequency EM heating of a reservoir directly depends on the continuous conductive path for electric current between electrodes, meaning that the reservoir water should always be in a liquid phase state, especially around the electrodes. Under this circumstance, based on the skin effect, a high frequency EM source can only heat up the close vicinity of the source due to large values for the loss properties of a water-saturated formation and consequently less depth of penetration. On the other hand, if the area around the EM source is dry, low frequency heating is not practical, and instead, high frequency EM waves (such as microwaves) can propagate through water-free reservoir regions and transfer the energy to a remote area. In this regard, a medium frequency EM source can benefit from advantages of both low and high frequency sources where electric conduction and dielectric polarization mechanisms may contribute in the heating process. In a reservoir, such a medium frequency source (for example, the lower part of the radio frequency band) can result in joule heating until the vapor chamber is formed and can provide dielectric heating after water evaporation.

The ability to use EM energy as part of in situ heavy oil production depends upon a number of factors that include: the presence of water; initial formation temperature; EM energy propagation through the formation; impedance matching and dielectric breakdown within the formation; and changes in the dielectric response of materials at different applied frequencies. Knowledge of the frequency-specific dielectric response of the formation will allow for optimization of process parameters for pay-zone identification and recovery. Water and minerals present in the formation can affect EM energy absorption by the reservoir. Both pore water saturation and mineral-bound water, in addition to mineral content, can affect the measured dielectric properties of the formation. At low temperatures, dielectric properties remain constant at higher frequencies, although the amount of EM energy absorbed by the formation is related to its organic content. The geometry of organics and inorganics within the formation/reservoir can also affect dielectric heating techniques. Dielectric properties differ in heated and non-heated samples, as shown by temperature dependent effects on measured dielectric properties. As a result, all these factors and physical parameters have to be considered during dielectric measurement in a formation. In fact, one of the potential applications of EM heating antennas could be EM dynamic (real-time) characterization of the formation while heating, as described below.

According to a first embodiment of the present invention, one or more broadband (or wideband) antennae, or insulated antennae, are used during RF-thermal recovery of hydrocarbon present in subsurface formations.

Due to reservoir heterogeneity before and during thermal recovery, the electromagnetic properties of the formation are continually changing. This results in the electrical impedance of the reservoir varying over time. For an RF antenna to have the maximum radiation efficiency, however, the impedance of the antennae (which is normally fixed and related to its fixed operating frequency) should be matched to the reservoir. The initial electrical impedance of the reservoir changes as its temperature rises, and hence an impedance mismatch between the antenna and the reservoir occurs, and therefore conventional antennae can fail quickly if applied to the RF heating process of a reservoir. This impedance mismatch or imbalance can then result in poor radiation efficiency and consequently the total low power efficiency.

According to this aspect of the present invention, broadband antennas are used to address this problem. These types of antennae can operate at a wide frequency bandwidth. The bandwidth of an antenna is defined as the range of frequencies within which the performance of the antenna, with respect to some characteristic, conforms to a specified standard. The bandwidth can be considered to be the range of frequencies on either side of a center frequency (usually the resonance frequency for a dipole), where the antenna characteristics (such as input impedance, pattern, beamwidth, polarization, side lobe level, gain, beam direction, and radiation efficiency) are within an acceptable value of those at the center frequency. For broadband antennas, the bandwidth is usually expressed as the ratio of the upper-to-lower frequencies of acceptable operation. For example, a 10:1 bandwidth indicates that the upper frequency is 10 times greater than the lower. Therefore, by using a broadband antenna, at each heating cycle when the frequency is matched to impedance of the reservoir, the performance of the antenna remains acceptable.

The bandwidth is usually formulated in terms of beamwidth, side lobe level, and pattern characteristics. Antennas with very large bandwidths (for example 40:1 or greater) have been designed in recent years. These are known as frequency independent antennas. There are different types of broadband antennas that could be considered for use with the present invention, including for example folded-dipoles, insulated (coated) dipole/loops, helix, and traveling-wave antenna, as would be known to those skilled in the art.

According to another aspect of the present invention, the impedance mismatch problem may be addressed by using insulated antennae. First, reservoir characteristics are determined by conventional means, and then it is calculated how the reservoir impedance would likely change after desiccation of the reservoir (which would occur to at least some extent adjacent the antenna due to the RF-thermal heating process), as impedance is affected primarily by water. Then, a dielectric (single or multi-layer) coating is applied on the antenna of interest to match its impedance to the calculated impedance (for desiccation conditions) of the part of the formation located in the vicinity of the antenna. Thus, where there is no production from the wellbore housing the antenna and a state of desiccation or near-desiccation is achieved around the antenna, a potentially permanent impedance match can be achieved in which the radiation efficiency does not decay. In this case, single frequency operation can be carried out and the need for periodic cyclic frequency tuning is minimized or potentially eliminated, reducing the cost and complexity of the system.

It is also known in the art to use so-called beamforming algorithms to direct or steer the EM energy to a desired portion of the reservoir or formation, as the target area may shift during recovery operations. According to another aspect of the present invention, then, an antennae array system for a smart RF-thermal recovery process is disclosed. By applying a system of antennae in array and using standard beamforming algorithms known to those skilled in the art, it has been determined that it is possible to direct a beam of radiated electromagnetic energy toward the hydrocarbon zone to have a more energy-efficient recovery process, as is illustrated in FIG. 1. In FIG. 1, an exemplary system 10 is illustrated having a production well 12 and a plurality of EM wells 14 drilled through overburden 20 into a pay zone 22. The EM wells 14 are each provided with a plurality of antennae 16 making up the array 18. The antenna array 18 produces a field pattern beam 24 to generate a heated zone 26, which heated zone 26 includes the target oil 28.

The array of antennae 18 could be constructed from any type of antennae applicable to RF-thermal recovery (including broadband antennae as disclosed above, although it will be clear that other types of antennae could be used). The antennae may be placed in either horizontal or vertical wellbores. The antenna array may be also in 1-dimensional configuration (lined up on a straight line in a wellbore, horizontal or vertical), 2-dimensional configuration (deployed in multiple wellbores, horizontal or vertical, where all the wellbores are located on the same geometrical plane), and 3-dimensional configuration (deployed in multiple wellbores, horizontal or vertical, where the wellbores are not located on the same geometrical plane). A higher dimension of array configuration yields more flexibility in adjusting the beam of the energy, at the expense of more cost and greater complexity.

From the reflection and transmitted signals, it is also possible to develop a real-time imaging algorithm to follow the dynamic change of the reservoir and aim the beam of RF energy to the area in the subsurface formation that needs to be heated to mobilize the target hydrocarbon. Note that in FIG. 1 the oil 28 is housed within the heated zone 26 and is therefore also being heated. It is also within the scope of the present invention to arrange the process to be automated and carried out through so-called "smart" and computerized systems, as would be within the knowledge of those skilled in the art having regard to the within teaching.

Any suitable types of RF radiators may be used with any aspect of this invention, such as linear, loops, slots, coils, and helical, based on the employed frequency range of operation.

Figure 2:
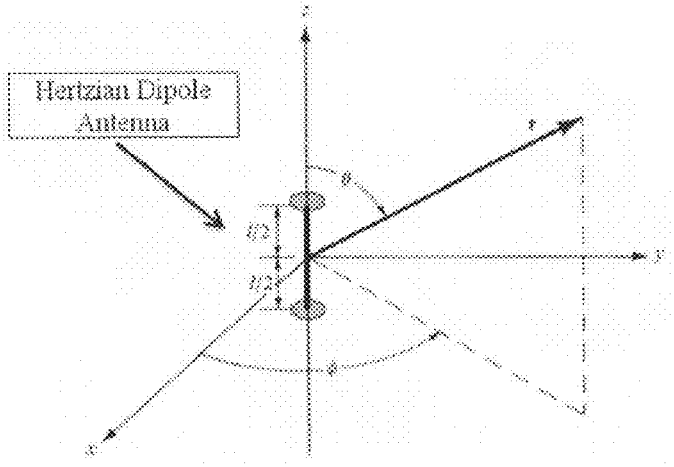
FIG. 2 is an example of a dipole antenna.

To explain the workflow of designing the beam of RF energy directed to the area of interest in a reservoir formation, a Hertzian dipole is taken into account as an example and for simplicity, as illustrated in FIG. 2.

The radiating electromagnet field components in spherical coordinates of such antenna is given by $$E_r = \sqrt{\frac{\mu_0}{\varepsilon}}\,\frac{Il}{2\pi r}\cos\theta\left(1+\frac{1}{jkr}\right)e^{-jkr} \tag{1}$$

$$E_\theta = j\sqrt{\frac{\mu_0}{\varepsilon}}\,\frac{kIl}{4\pi r}\sin\theta\left(1+\frac{1}{jkr}-\frac{1}{(kr)^2}\right)e^{-jkr}$$

$$H_\varphi = j\frac{kIl}{4\pi r}\sin\theta\left(1+\frac{1}{jkr}\right)e^{-jkr}$$

where $j=\sqrt[2]{-1}$ and $$k=\omega\sqrt{\mu_0\varepsilon} \tag{2}$$

$$\varepsilon=\varepsilon_0\left(\varepsilon'-j\left(\varepsilon''+\frac{\sigma}{\varepsilon_0\omega}\right)\right)$$

where $\omega$, $\mu_0$, $\in_0$, $\in'-j\in''$, $\sigma$, are the angular frequency, magnetic permeability of vacuum, electrical permittivity of vacuum, relative complex permittivity of reservoir, and electrical conductivity of reservoir, respectively. If the dipole antenna is placed at a different location in the global coordinate system, i.e., $(x_i, y_i, z_i)$, then the proper coordinate transformation should be applied to obtain the EM field values at the reference system.

Figure 3:
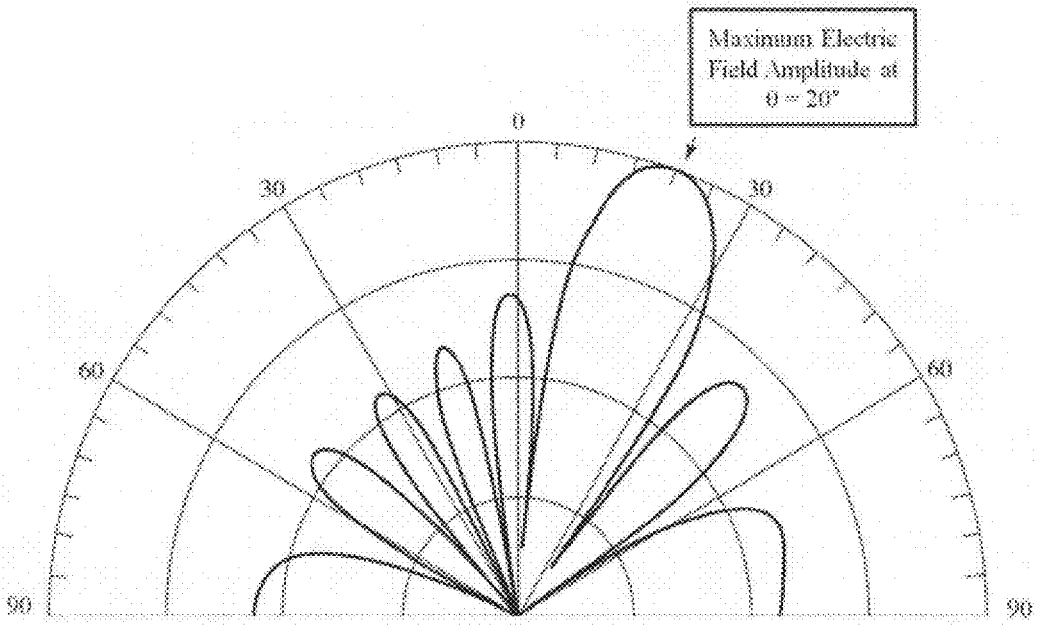
FIG. 3 is an illustration of electric field intensity as a function of azimuthal angle.

Assuming no coupling between the array elements, the total electric field radiated by N-element antenna array is given by $$E_{total}=\sum_{i=1}^{N}E^{(i)}e^{j\beta_i} \tag{3}$$

where $\beta_i$ is the phase shift of each element's excitation power. The phases can be set so that the maximum amplitude of $|E_{total}|$ occurs at a particular space angle$(\theta,\phi)$, as shown schematically in FIGS. 1 and 2, while FIG. 3 illustrates electric field intensity as a function of azimuthal angle. This can be done using various optimization techniques such as least square method, which is a common practice in wireless telecommunication systems. Such beam steering can focus the energy to the area that needs to be heated up rather than radiation of EM energy in all directions.

As embodiments of the present invention would also benefit from real-time information on the reservoir during recovery, another aspect of the present invention involves switching the antennae used to heat the reservoir to use as a transceiver to provide information on petrophysical characteristics of the reservoir. RF-thermal recovery is a very dynamic process and reservoir properties vary as the heating process and hydrocarbon production are taking place. It is therefore advantageous to obtain information characterizing the changing reservoir in real time.

The same antenna (or array of antennae) that is being used to heat the reservoir (in either vertical or horizontal wellbores) is switched to low-power mode and employed to send and receive electromagnetic measuring signals (which would be at multi-frequencies when broadband antennae are used as described above) through which reservoir electrical properties can be calculated using standard inversion algorithms known to those skilled in the art, similar to techniques used in cross-well electromagnetic imaging or electromagnetic impedance tomography, also known to those skilled in the art.

Unlike the prior art, embodiments of the present invention may incorporate temperature information into the inversion algorithm of EM measured through the multi-physics phenomenon of a coupled electromagnetic-"thermal fluid flow in porous medium" scheme thus potentially improving the accuracy and convergence of the inversion results. The temperature data may be gathered from thermal sensors installed in an RF well, production well or monitoring well. Similar to other tomography processes, the more measured data that is provided, the more accurate the results which can be obtained. Other reservoir and production information (if available, such as reservoir transient pressure) may be added to the inversion process to further improve the algorithm.

The updated reservoir characteristics can then be utilized to tune the power, frequency and possibly the beam direction of the EM energy (when smart antennae are employed as described above) to improve the efficiency of the recovery process.

Physics of multi-phase fluid-flow and radio frequency electromagnetic wave propagation phenomena in porous media can be coupled by means of appropriate equations, which incorporates the dependency of electrical properties of the reservoir formation (such as electrical resistivity and dielectric permittivity) on temperature and fluid saturation.

Thus, a multi-physics inversion algorithm for the quantitative joint interpretation of geo-electrical and flow-related measurements can be formulated to yield an estimation of the underlying petrophysical model of the reservoir formation.

For the multi-physics imaging, time-lapse (multi-snapshot) electromagnetic measurements of transmitted and reflected EM signals are conducted at multiple receiver locations (antenna array elements placed in vertical and/or horizontal wellbores), and multiple frequencies at low power mode. Also, multi-probe measurements of reservoir pressure and temperature are acquired to be used in the inversion and imaging algorithm.

Joint inversion of the underlying petrophysical model is posed as an optimization problem that involves the minimization of an objective function subject to physical constraints. The following objective function can be adopted for this purpose, known to those skilled in the art:

$$c(x)=\mu(\|W_d\cdot e(x)\|-\chi^2)+\|W_x\cdot(x-x_p)\|^2 \quad (4)$$

In the above expression, we define the vector of residuals, e(x), as a vector whose j-th element is the residual error (data mismatch) of the j-th measurement. The residual error as the difference between the measured and predicted normalized responses, is given by $$e(x)=[(S_1(x)-m_1), \ldots ,(S_M(x)-m_M)]^T=S(x)-m \quad (5)$$

In the above expression, M is the number of measurements, $m_j$ denotes the normalized observed response (measured data), and $S_j$ corresponds to the normalized simulated response as predicted by the vector of model parameters, x, given by $$x=[x_1, \ldots ,x_N]^T=y-y_R \quad (6)$$

where N is the number of unknowns. The vector of model parameters, x, is represented as the difference between the vector of the actual model parameters, y, and a reference model, $y_R$. All a priori information on the model parameters such as those derived from independent measurements are provided by the reference model. The scalar factor, i.e., $(0<\mu<\infty)$ is a regularization parameter for determining the relative importance of the two terms of the objective function. The choice of $\mu$ produces an estimate of the model x that has a finite minimum-weighted norm away from a prescribed model, $x_p$, and which globally misfits the data to within a prescribed value $\chi$ determined from a priori estimates of noise in the data. The second term in the objective function is included to regularize the optimization problem. This term suppresses magnification of errors in the parameter estimation due to measurement noise. The matrix $W_x^TW_x$ is the inverse of the model covariance matrix that represents the degree of confidence in the prescribed model, $x_p$, and $W_d^TW_d$ is the inverse of the data covariance matrix describing the estimated uncertainties in the data, i.e., due to noise contamination. In the inversion algorithm the vector of measurements, m, is constructed with two categories of data: (a) multi-probe formation temperature and pressure measurements as a function of time, and (b) multi-receiver, multi-frequency, and multi-snapshot (time-lapse) EM reflection measurements. If desired, the described algorithm can also be used for single-data-type inversions.

Also, as the energy beam of the antenna array is directed toward the area of interest in the reservoir formation, adaptive beamforming algorithms can be well applied for this purpose, which are commonly used in telecommunication systems, known to those skilled in the art.

Figure 4:
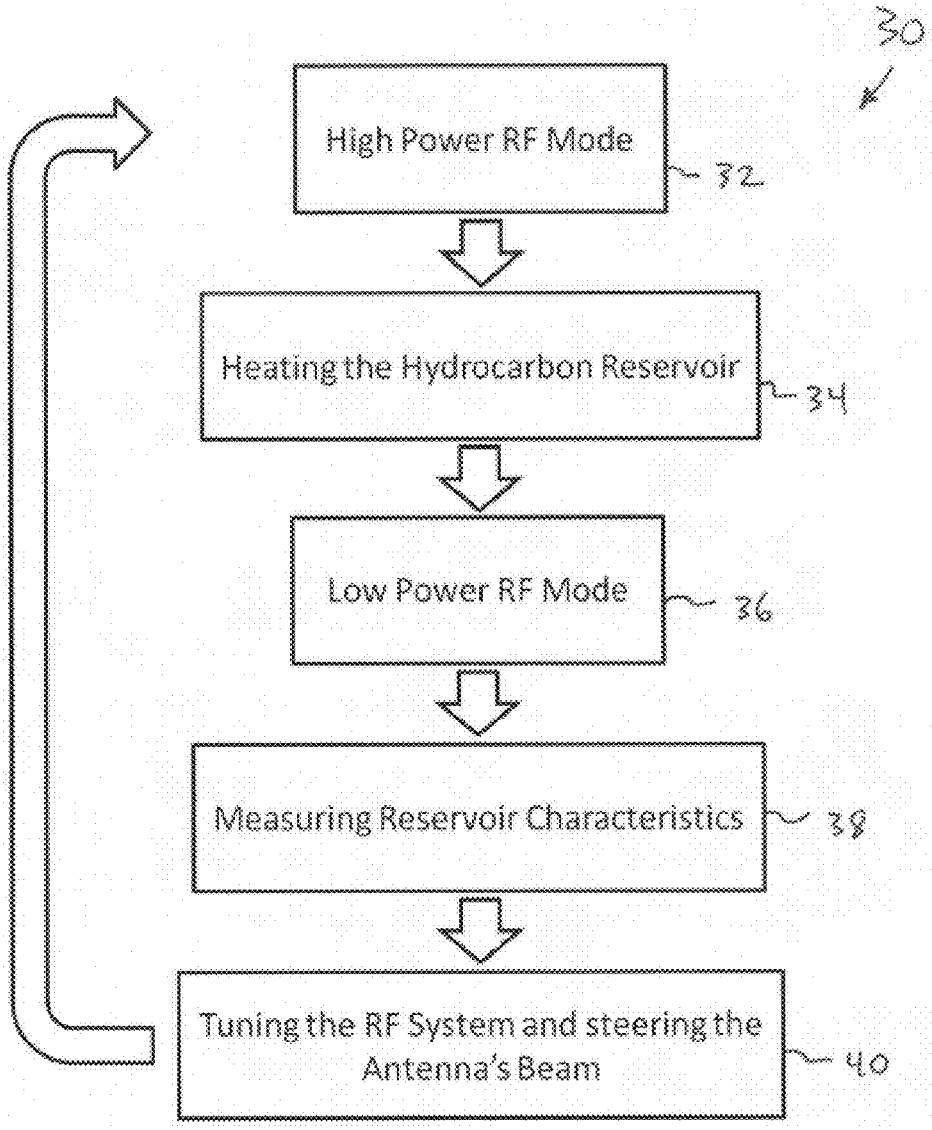
FIG. 4 is a flowchart of a method according to an embodiment of the present invention.

An exemplary process 30 is illustrated in FIG. 4. The process 30 begins with the RF tool or other source (which may be the broadband antenna described above) operating at step 32 in high-power RF mode. At step 34, this RF energy is applied to the reservoir to heat the reservoir. Once this is completed, at step 36 the RF tool or source is switched to low-power operation, and at step 38 this is used to measure the reservoir characteristics. With this information, the RF system can be tuned at step 40 and the antenna's beam can be steered as desired. This series of steps can be repeated as appropriate.

As will be clear from the above, those skilled in the art would be readily able to determine obvious variants capable of providing the described functionality, and all such variants and functional equivalents are intended to fall within the scope of the present invention.

Specific examples have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A method for recovering hydrocarbon from a subsurface formation, the method comprising the steps of:

a. drilling at least one well into the formation adjacent the hydrocarbon;

b. positioning at least one antenna in the at least one well, the at least one antenna operable over a wide frequency bandwidth for improving performance in an impedance-variant reservoir; wherein the at least one antenna is at least one broadband antenna, at least one wideband antenna or at least one frequency independent antenna;

c. emitting electromagnetic energy from the at least one antenna into the formation;

d. allowing the electromagnetic energy to heat the hydrocarbon and reduce the viscosity of the hydrocarbon; and e. producing the heated hydrocarbon to surface.

2. The method of claim 1 wherein the electromagnetic energy is in a radio frequency range.

3. The method of claim 2 wherein the radio frequency range is in a lower part of the radio frequency range.

4. The method of claim 1 wherein the at least one antenna comprises a plurality of antennae in an array.

5. The method of claim 4 wherein the array is configured to direct the electromagnetic energy in a direction determined by at least one beamforming algorithm.

6. The method of claim 1 comprising the further steps after step e of:

switching the at least one antenna from a high-power heating mode to a low-power transceiver mode; receiving data regarding formation characteristics using the at least one antenna; and transmitting the data using the at least one antenna.

7. The method of claim 6 comprising the further step of using the data to tune the at least one antenna and direct the electromagnetic energy.

8. A method for improving an electromagnetic-thermal hydrocarbon recovery process employing at least one well in a formation adjacent a hydrocarbon, the method comprising the steps of:

a. positioning at least one antenna in the at least one well, the at least one antenna operable over a wide frequency bandwidth for improving performance in an impedance-variant reservoir; wherein the at least one antenna is at least one broadband antenna, at least one wideband antenna or at least one frequency independent antenna;

b. emitting electromagnetic energy from the at least one antenna into the formation;

c. allowing the electromagnetic energy to heat the hydrocarbon and reduce the viscosity of the hydrocarbon;

d. producing the heated hydrocarbon to surface; and e. allowing the at least one antenna to compensate for impedance mismatch with variable electrical impedance of the formation during production.

9. A method for improving an electromagnetic-thermal hydrocarbon recovery process employing at least one well in a formation adjacent a hydrocarbon, the method comprising the steps of:

a. calculating a post-desiccation impedance change in the formation near the at least one well;

b. applying at least one coat of dielectric material to at least one antenna to match the calculated post-desiccation impedance change;

c. positioning the at least one antenna in the at least one well;

d. emitting electromagnetic energy from the at least one antenna into the formation;

e. allowing the electromagnetic energy to heat the hydrocarbon and reduce the viscosity of the hydrocarbon; and f. producing the heated hydrocarbon to surface.

10. The method of claim 9 wherein a single layer of the dielectric material is applied to the at least one antenna.

11. The method of claim 9 wherein a plurality of layers of the dielectric material is applied to the at least one antenna.

12. The method of claim 9 wherein the at least one antenna comprises a plurality of antennae in an array.

13. The method of claim 12 wherein the array is configured to direct the electromagnetic energy in a direction determined by at least one beamforming algorithm.

14. The method of claim 9 comprising the further steps after step f of: switching the at least one antenna from a high-power heating mode to a low-power transceiver mode; receiving data regarding formation characteristics using the at least one antenna; and transmitting the data using the at least one antenna.

15. The method of claim 14 comprising the further step of using the data to tune the at least one antenna and direct the electromagnetic energy.

16. A method for recovering hydrocarbon from a subsurface formation, the method comprising the steps of:

a. drilling at least one well into the formation adjacent the hydrocarbon;

b. calculating a post-desiccation impedance change in the formation near the at least one well;

c. applying at least one coat of dielectric material to at least one antenna to match the calculated post-desiccation impedance change;

d. positioning the at least one antenna in the at least one well;

e. emitting electromagnetic energy from the at least one antenna into the formation;

f. allowing the electromagnetic energy to heat the hydrocarbon and reduce the viscosity of the hydrocarbon; and g. producing the heated hydrocarbon to surface.

17. The method of claim 16 wherein a single layer of the dielectric material is applied to the at least one antenna.

18. The method of claim 16 wherein a plurality of layers of the dielectric material is applied to the at least one antenna.

19. The method of claim 16 wherein the at least one antenna comprises a plurality of antennae in an array.

20. The method of claim 19 wherein the array is configured to direct the electromagnetic energy in a direction determined by at least one beamforming algorithm.

21. The method of claim 16 comprising the further steps after step g of:

switching the at least one antenna from a high-power heating mode to a low-power transceiver mode; receiving data regarding formation characteristics using the at least one antenna; and transmitting the data using the at least one antenna.

22. The method of claim 21 comprising the further step of using the data to tune the at least one antenna and direct the electromagnetic energy.

23. A system for recovering hydrocarbon from a subsurface formation, the system comprising:

at least one production well drilled into the formation adjacent the hydrocarbon;

at least one electromagnetic energy application well drilled into the formation; and at least one antenna in the at least one electromagnetic energy application well, the at least one antenna operable over a wide frequency bandwidth for improving performance in an impedance-variant reservoir; wherein the at least one antenna is at least one broadband antenna, at least one wideband antenna or at least one frequency independent antenna;

wherein the at least one antenna is operable to emit electromagnetic energy into the formation to heat the hydrocarbon and reduce the viscosity of the hydrocarbon; and wherein the heated hydrocarbon is produced to surface through the at least one production well.

24. The system of claim 23 wherein the electromagnetic energy is in a radio frequency range.

25. The system of claim 24 wherein the radio frequency range is in a lower part of the radio frequency range.

26. The system of claim 23 wherein the at least one antenna comprises a plurality of antennae in an array.

27. The system of claim 26 wherein the array is configured to direct the electromagnetic energy in a direction determined by at least one beamforming algorithm.

28. The system of claim 23 wherein the at least one antenna is switched from a high-power heating mode to a low-power transceiver mode, and is configured to receive data regarding formation characteristics and transmit the data.

29. The system of claim 28 wherein the data is used to tune the at least one antenna and direct the electromagnetic energy.

* * * * *